US008066545B2

(12) United States Patent
Jourdian et al.

(10) Patent No.: US 8,066,545 B2
(45) Date of Patent: Nov. 29, 2011

(54) TOY VEHICLE TRACK PLAY SET

(75) Inventors: Robert William Jourdian, Elma, NY (US); William J. Maloney, II, East Aurora, NY (US); Larry R. Nagode, East Aurora, NY (US); Timothy J. Trapp, Orchard Park, NY (US)

(73) Assignee: Mattel, Inc., El Segundo, CA (US)

( * ) Notice: Subject to any disclaimer, the term of this patent is extended or adjusted under 35 U.S.C. 154(b) by 143 days.

(21) Appl. No.: 12/575,089

(22) Filed: Oct. 7, 2009

(65) Prior Publication Data

US 2011/0081825 A1 Apr. 7, 2011

(51) Int. Cl.
*A63H 18/02* (2006.01)
*A63H 18/00* (2006.01)

(52) U.S. Cl. ..... 446/444; 446/174

(58) Field of Classification Search ..... 446/168–174, 446/431, 444, 445, 448; 238/10 E
See application file for complete search history.

(56) References Cited

U.S. PATENT DOCUMENTS

| | | | | |
|---|---|---|---|---|
| 1,212,332 | A | | 1/1917 | Ensign et al. |
| 1,347,968 | A | | 7/1920 | O'Doie |
| 1,509,020 | A | | 9/1924 | Mulligan |
| 2,992,598 | A | | 7/1961 | Einfalt |
| 3,299,565 | A | | 1/1967 | Yarashes |
| 3,603,505 | A | | 9/1971 | Tsugawa |
| 3,760,532 | A | | 9/1973 | Campion |
| D246,196 | S | * | 10/1977 | Suzuki ..... D21/564 |
| 4,156,986 | A | | 6/1979 | Kupperman et al. |
| 4,357,778 | A | | 11/1982 | Matsumoto et al. |
| D289,666 | S | | 5/1987 | Udagawa et al. |
| 4,921,458 | A | | 5/1990 | Greenwood |
| D366,290 | S | | 1/1996 | Dieudonne |
| 5,893,791 | A | | 4/1999 | Wilkinson |
| 6,071,173 | A | | 6/2000 | Kelley |
| D442,648 | S | | 5/2001 | Ohkado et al. |
| 6,241,573 | B1 | | 6/2001 | Ostendorff et al. |
| 6,478,654 | B1 | | 11/2002 | Rehkemper et al. |
| 6,945,839 | B2 | | 9/2005 | Quercetti |
| 7,241,223 | B1 | | 7/2007 | Caudill |
| 7,347,764 | B2 | | 3/2008 | Choi |
| 7,614,931 | B2 | | 11/2009 | Nuttall |
| 2002/0108527 | A1 | | 8/2002 | Annis |
| 2006/0084361 | A1 | | 4/2006 | Favorito et al. |
| 2008/0009224 | A1 | | 1/2008 | Nuttall et al. |
| 2008/0113585 | A1 | | 5/2008 | Payne |
| 2008/0227364 | A1 | | 9/2008 | Todokoro |

OTHER PUBLICATIONS

PCT International Search Report for PCT/US2010/048898, dated May 26, 2011.

* cited by examiner

*Primary Examiner* — Kien Nguyen
(74) *Attorney, Agent, or Firm* — Edell, Shapiro & Finnan, LLC

(57) ABSTRACT

A vehicle track play set includes a base, a plate coupled to and extending upwardly from the base, and first and second tracks extending along the plate toward the base. The first track includes a first curved portion extending outwardly from a first surface of the plate and a second curved portion extending outwardly from an opposite second surface of the plate. The first track extends through a first opening in the plate between the first and second curved portions. The second track includes a third curved portion extending outwardly from the second surface and a fourth curved portion extending outwardly from the first surface. The second track extends through a second opening in the plate between the third and fourth curved portions.

19 Claims, 15 Drawing Sheets

TOY VEHICLE TRACK PLAY SET

FIELD OF THE INVENTION

The present invention relates to a play set, in particular a vehicle track play set, including a base, a support member extending upwardly from the base and defining several openings, and a track coupled to the support member. The track has a spiral configuration and extends through the openings.

BACKGROUND OF THE INVENTION

Various play sets including a track along which unpowered toy vehicles move are known. Some conventional play sets include a track disposed along a single horizontal plane. Other conventional play sets include a track that includes a vertical displacement as well as a horizontal displacement. Such conventional track play sets have long been a source of entertainment for children.

There is a need for a vehicle track play set having different features and a unique track configuration, thereby enhancing a child's enjoyment and play experience. Further, there is a need for a unique and different vehicle track play set suitable for very small children.

SUMMARY OF THE INVENTION

The present invention relates to a vehicle track play set including a base, a substantially planar support member extending upwardly from the base, and a track. The support member has a first end connected to the base and an opposite distal second end. The support member defines a plurality of openings extending therethrough. The track has a first end portion coupled to the support member and an opposite second end portion. The track has a spiral configuration and extends through the plurality of openings from the first end portion of the track to the second end portion of the track.

In one embodiment, the track extends outwardly from opposing sides of the support member. The track may remain within a footprint defined by the base as the track extends from its first end portion to its second end portion.

In one embodiment, the track is a first track and the plurality of openings is a first plurality of openings. The vehicle track play set further includes a second track having a first end portion coupled to the support member and an opposite second end portion. The second track has a spiral configuration and extends through a second plurality of openings defined by the support member.

In one embodiment, the base includes a first portion and a second portion spaced from the first portion. The first track is coupled to the first portion of the base, and the second track is coupled to the second portion of the base. In one embodiment, the first end portion of the first track extends outwardly from a first side of the support member, and the first end portion of the second track extends outwardly from an opposite second side of the support member.

The present invention also relates to a vehicle track play set including a base, a plate having a first end coupled to the base and an opposite second end, a first track extending along the plate toward the base, and a second track extending along the plate toward the base. The plate includes opposing first and second surfaces. The first track includes a first curved portion extending outwardly from the first surface and a second curved portion extending outwardly from the second surface. The first track extends through at least a first opening in the plate between the first curved portion and the second curved portion. The second track includes a third curved portion extending outwardly from the second surface and a fourth curved portion extending outwardly from the first surface. The second track extends through at least a second opening in the plate between the third curved portion and the fourth curved portion.

In one embodiment, the first opening in the plate includes a first plurality of openings, and the first track has a spiral configuration and extends through the first plurality of openings. In one embodiment, the second opening in the plate includes a second plurality of openings, and the second track has a spiral configuration and extends through the second plurality of openings. In one embodiment, the first opening in the plate includes a first quantity of openings, and the second opening in the plate includes a second quantity of openings, the first quantity differing from the second quantity.

In one embodiment, the first track is coupled to a first exit ramp extending from a first side of the base, and the second track is coupled to a second exit ramp extending from a second side of the base opposite the first side. In one embodiment, the base includes a first portion and a second portion spaced from the first portion, the first track being coupled to the first portion of the base, and the second track being coupled to the second portion of the base.

In one embodiment, the first curved portion of the first track extends outwardly from the first surface of the plate by a first distance. The second curved portion of the first track extends outwardly from the second surface of the plate by a second distance, the second distance being substantially equal to the first distance.

The present invention also relates to a vehicle track play set including a base, a support extending upwardly from the base, and first and second tracks. The support has a first end connected to the base and an opposite distal second end. The support defines a first plurality of openings and a second plurality of openings. The first track has a first end portion connected to the support and a second opposite end portion. The first track has a spiral configuration and extends through the first plurality of openings of the support between the end portions of the first track. The second track has a first end portion connected to the support and a second opposite end portion. The second track has a spiral configuration and extends through the second plurality of openings of the support between the end portions of the second track.

In one embodiment, the support includes a first side and a second side extending between the ends of the support. The first end portion of the first track extends outwardly from the first side of the support. The first end portion of the second track extends outwardly from the second side of the support.

In one embodiment, the second end portion of the first track is located proximate to a first side of the base, and the second end portion of the second track is located proximate to a second side of the base opposite to the first side. In one embodiment, the base includes a first portion and a second portion spaced from the first portion. The second end portion of the first track is coupled to the first portion of the base, and the second end portion of the second track is coupled to the second portion of the base.

BRIEF DESCRIPTION OF THE DRAWINGS

Like reference numerals have been used to identify like elements throughout this disclosure.

DETAILED DESCRIPTION OF THE INVENTION

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

Figure 1:
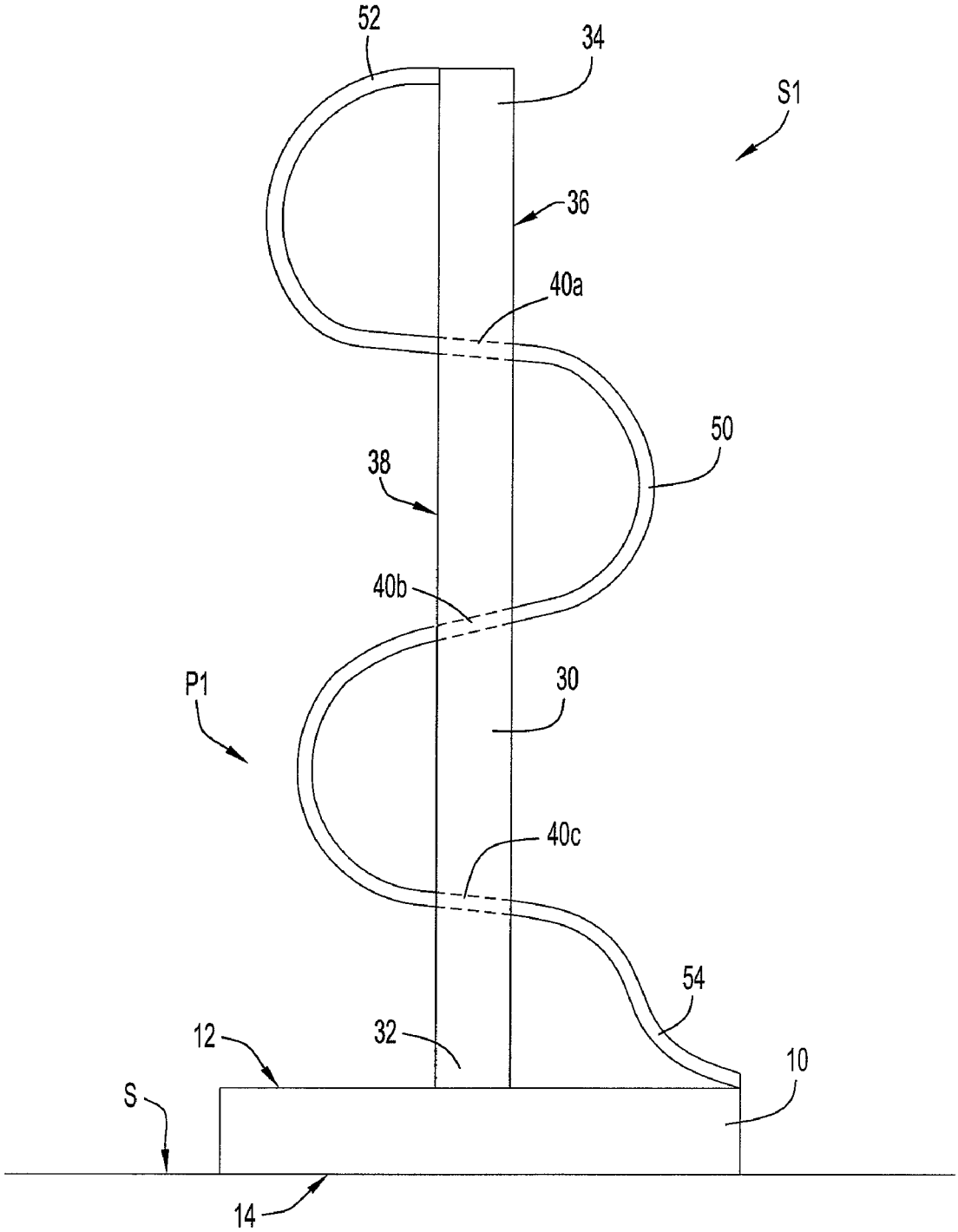
FIG. 1 illustrates a side view schematic diagram of a vehicle track play set according to an embodiment of the present invention.

FIG. 1 illustrates a schematic diagram of a vehicle track play set Si according to an embodiment of the present invention. Play set S1 includes a base 10 and a substantially planar support member 30 extending upwardly from the base 10. The support member 30 has a lower end 32 connected to the base 10, an opposite distal upper end 34, and opposing sides 36, 38. In one embodiment, the lower end 32 can be coupled to an upper surface 12 of the base 10. The support member 30 defines several openings 40*a*, 40*b*, 40*c* (shown in phantom) extending therethrough.

A track 50 includes an end portion 52 coupled to the support member 30 and an opposite end portion 54. In one embodiment, the end portion 52 of the track 50 is located proximate to the upper end 34 of the support member 30, and the opposite end portion 54 of the track 50 is located proximate to the lower end 32 of the support member 30. The track 50 may have a generally spiral configuration and extends through the openings 40*a*, 40*b*, 40*c* in the support member 30 from end portion 52 of the track 50 to end portion 54 of the track 50.

The track 50 extends outwardly from the opposing sides 36, 38 of the support member 30. In some embodiments, the track 50 remains within a footprint defined by the base 10 as the track 50 extends from end portion 52 to opposite end portion 54. The play set S1 is relatively stable and not easily tipped over from an upright position P1 with an underside 14 of the base 10 disposed on a support surface S. Thus, the base 10 and/or the support member 30 has a size and weight sufficient to stabilize and maintain the play set S1 in its upright position P1. In other embodiments, the track 50 extends outwardly from the opposing sides 36, 38 of the support member 30 and beyond the footprint defined by the base 10. The base 10 and/or support member 30 are sufficiently weighted to ensure that the base 10 is stable and easily maintained in the upright position P1 on the support surface S.

The track 50 is configured for receiving toy vehicles (such as toy vehicles 700 described below). In one embodiment, the downward slope of the track 50 is sufficient to allow non-powered wheeled vehicles to proceed from its upper end portion 52 to its lower end portion 54 via gravity. In other embodiments, the play set S1 includes powered vehicles which are received on and move along the track 50. The track 50 includes side portions that maintain a toy vehicle on the track 50.

Figure 2:
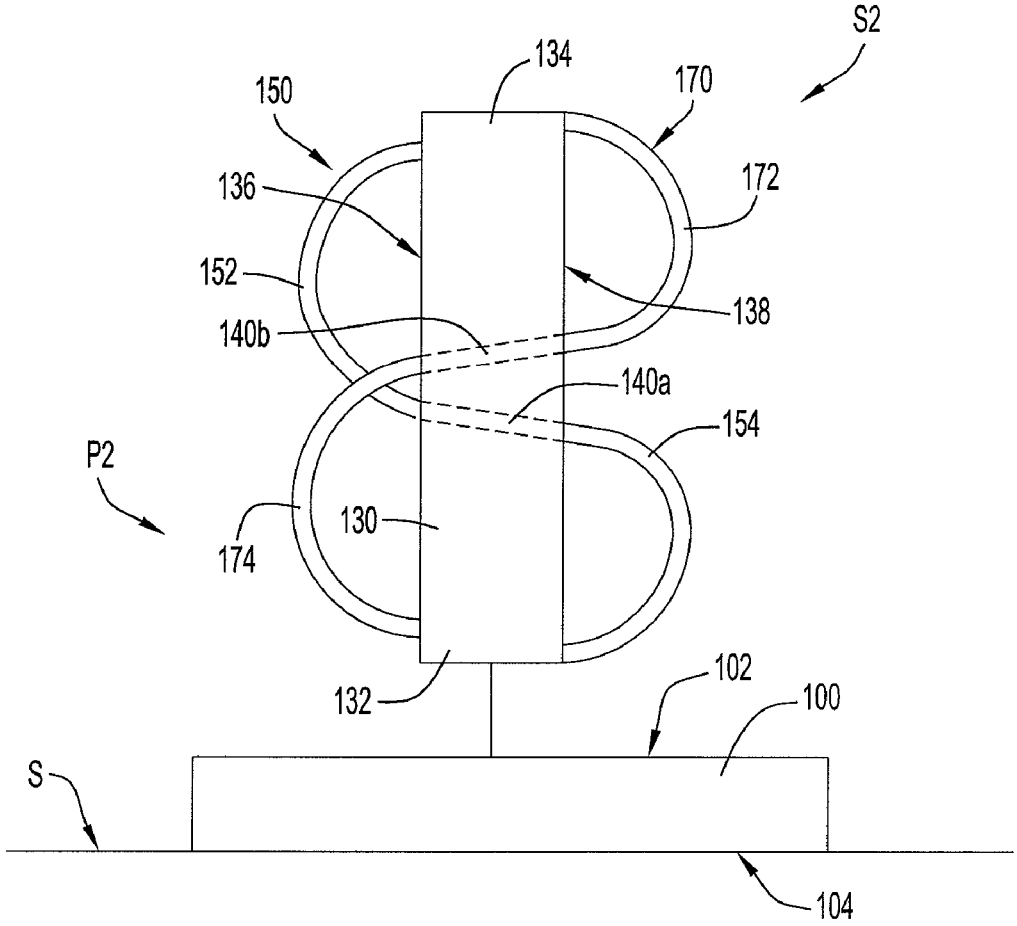
FIG. 2 illustrates a side view schematic diagram of a vehicle track play set according to an alternative embodiment.
Figure 3:
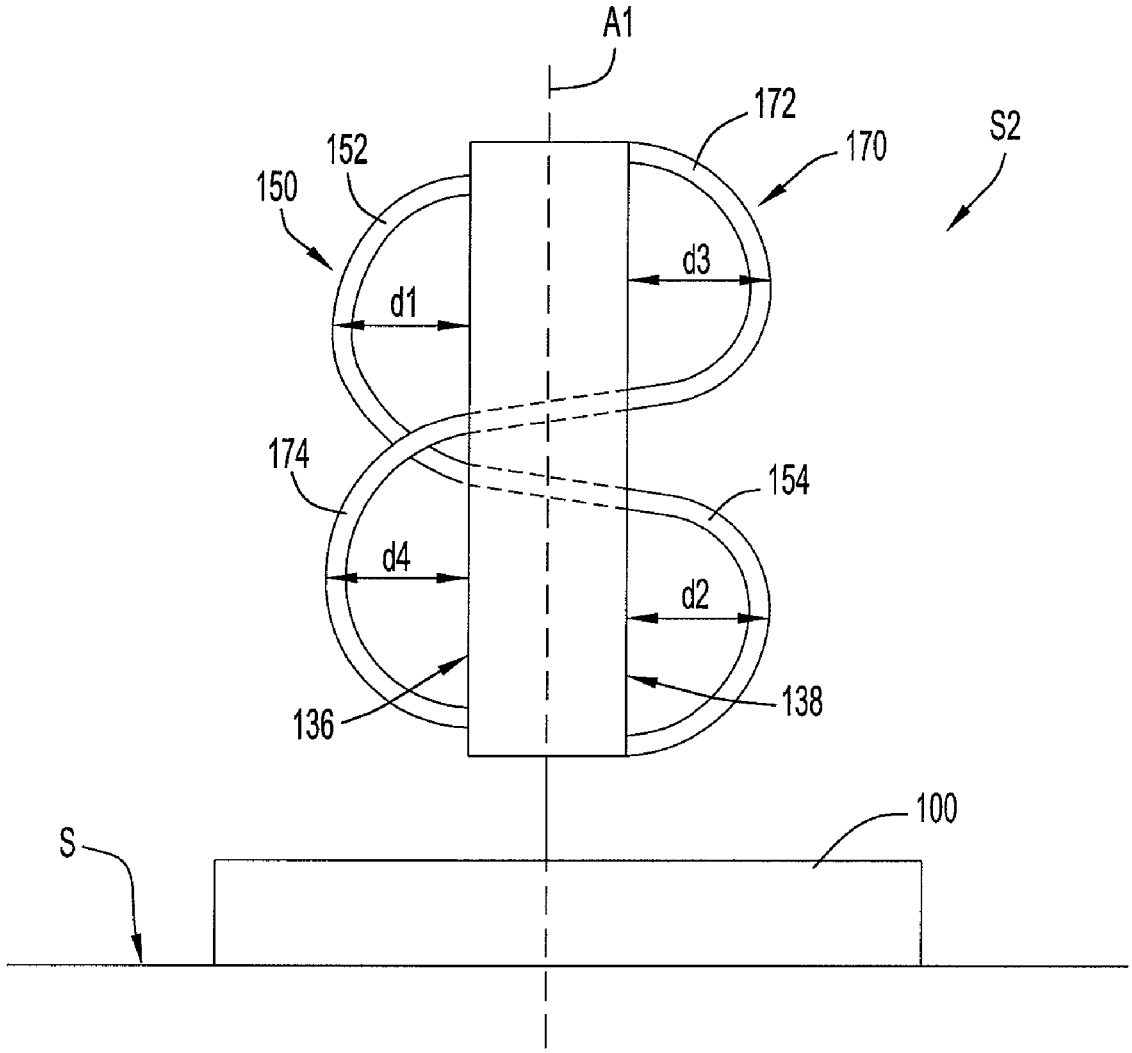
FIG. 3 illustrates another side view schematic diagram of the play set of FIG. 2.

FIGS. 2 and 3 illustrate schematic diagrams of a vehicle track play set S2 according to another embodiment. Referring first to FIG. 2, play set S2 includes a base 100 and a plate 130 extending upwardly from an upper surface 102 of the base 100. The plate 130 includes a lower end 132 coupled to the base 100, an opposite upper end 134, and opposing surfaces 136, 138, respectively. In some embodiments, the lower end 132 of the plate 130 is directly connected to the upper surface 102 of the base 100. In other embodiments, an additional connecting component couples the lower end 132 of the plate 130 to the upper surface 102 of the base 100.

A first track 150 extends along the plate 130 toward the base 100. The first track 150 includes a curved portion 152 extending outwardly from surface 136 of the plate 130, and another curved portion 154 extending outwardly from surface 138 of the plate 130. The first track 150 extends through at least one opening 140*a* defined by the plate 130 between curved portion 152 and curved portion 154.

A second track 170 extends along the plate 130 toward the base 100. The second track 170 includes a curved portion 172 extending outwardly from surface 138 of the plate 130 and another curved portion 174 extending outwardly from the opposing surface 136 of the plate 130. The second track 170 extends through at least one other opening 140*b* defined by the plate 130 between curved portion 172 and curved portion 174.

In one embodiment, the first track 150 remains within a footprint defined by the base 100 as the first track 150 extends from its curved portion 152 to its curved portion 154. Similarly, the second track 170 remains within the footprint of the base 100 as the second track 170 extends from its curved portion 172 to its curved portion 174. The play set S2 is relatively stable and not easily tipped over from an upright position P2 with an underside 104 of the base 100 disposed on the support surface S.

In other embodiments the first track 150 and/or the second track 170 extend outwardly from surface 136 and/or surface 138 of the plate 130 and beyond the footprint of the base 100. The base 100 and/or the plate 130 should be sufficiently configured and weighted to ensure that the play set S2 is relatively stable and easily maintained in the upright position P2 on the support surface S, even if the base 100, the plate 130, and/or the first or the second tracks 150, 170 are bumped or pushed, such as during play.

In one embodiment, each of the first and second tracks 150, 170 has a generally S-shaped configuration, spiraling from the upper end 134 of the plate 130 toward the lower end 132 of the plate 130. Referring to FIG. 3, the curved portion 152 of the first track 150 extends outwardly from surface 136 of the plate 130 by a first distance d1, and the curved portion 154 of the first track 150 extends outwardly from the opposing surface 138 of the plate 130 by a second distance d2. In one embodiment, the first distance d1 is substantially equal to the second distance d2, thereby giving the play set S2 a symmetrical appearance. In other embodiments, the first distance d1 differs from the second distance d2. By varying the distances d1 and d2, the appearance of the play set S2 as well as the movement of the toy vehicles on the track 150 can vary.

Similarly, the curved portion 172 of the second track 170 extends outwardly from surface 138 of the plate 130 by a third distance d3, and the curved portion 174 of the second track 170 extends outwardly from the opposing surface 136 of the plate 130 by a fourth distance d4. In one embodiment, the third distance d3 is substantially equal to the fourth distance d4, thereby giving the play set S2 a symmetrical appearance. In other embodiments, the third distance d3 differs from the fourth distance d4. By varying the distances d3 and d4, the appearance of the play set S2 as well as the movement of the toy vehicles on the track 150 can vary.

In one embodiment, the first and third distances d1, d3 are substantially equal, and the second and fourth distances d2, d4 are substantially equal. Thus, the curved portions 152, 174 extending outwardly from surface 136 are generally symmetrical with the curved portions 172, 154 extending outwardly from the opposing surface 138, relative to a longitudinal axis A1 of the plate 130. The resulting configuration of the play set S2 is relatively stable and not easily tipped from its upright position P2.

The play set S2 may include or be used with one or more toy vehicles (such as toy vehicles 700 described below). In one embodiment, the first and second tracks 150, 170 are configured for receiving single-wheeled toy vehicles suitable for use by toddlers and young children. The downward slopes of the first and second tracks 150, 170 are sufficient to allow non-powered wheeled vehicles to proceed down the tracks 150, 170 via gravity. In one embodiment, each of the tracks 150, 170 has side edges that are configured to prevent the toy vehicles from falling off of the track.

The multi-track spiraling configuration of play set S2 provides an appealing appearance and unique play experience for children. Toy vehicles may proceed down the first and second tracks 150, 170 simultaneously toward the base 100. Play set S2 may further include sensory output, such as lights, sound effects and/or music, which is triggered via switches or push buttons on the base 100 and/or the plate 130. Alternatively or in addition, one or more switches may be provided on or adjacent the first track 150 and/or the second track 170, which are triggered as a toy vehicle passes and cause activation of lights, sound effects, or other sensory output.

Figure 4:
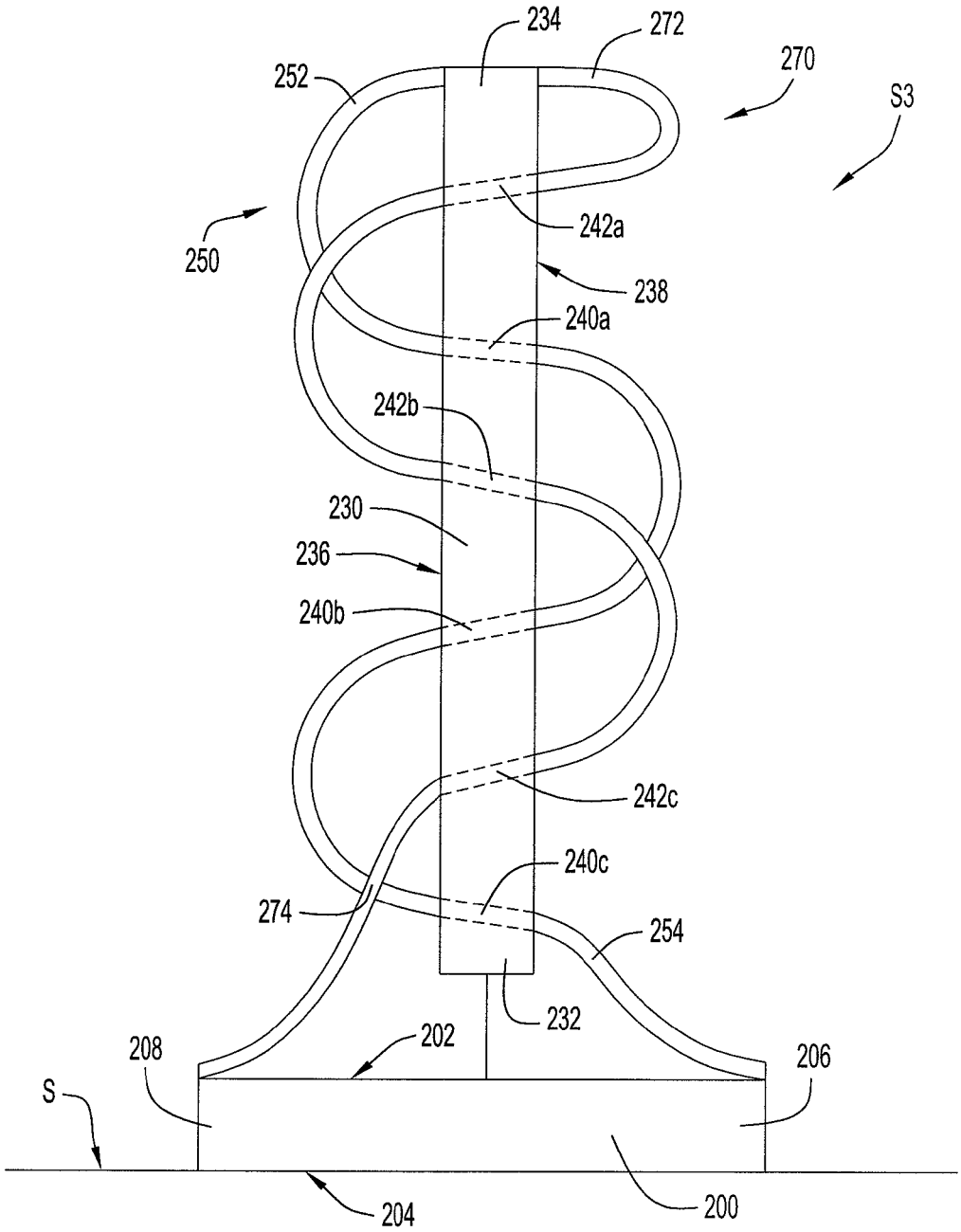
FIG. 4 illustrates a side view schematic diagram of a vehicle track play set according to an alternative embodiment.
Figure 5:
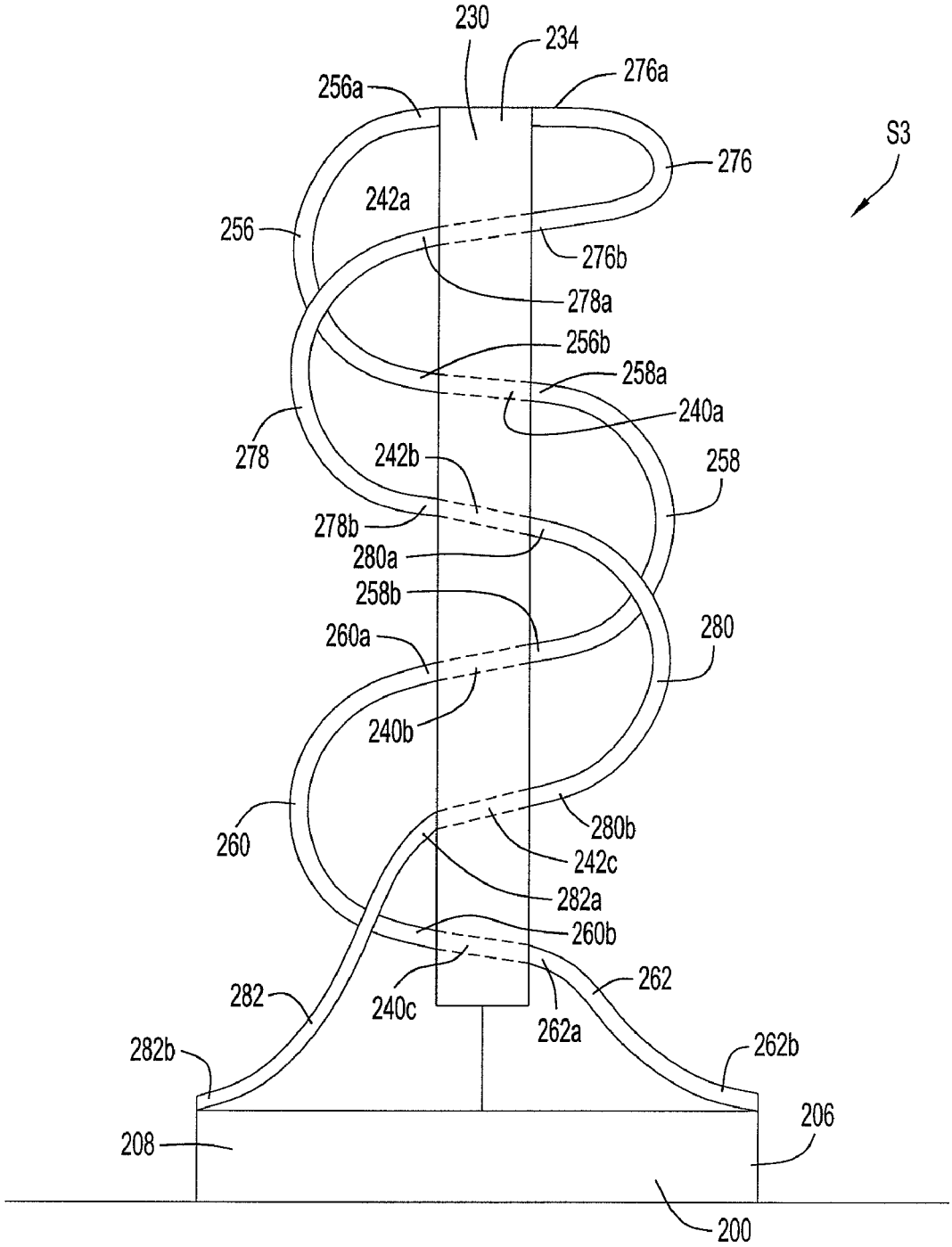
FIG. 5 illustrates another side view schematic diagram of the play set of FIG. 4.
Figure 6:
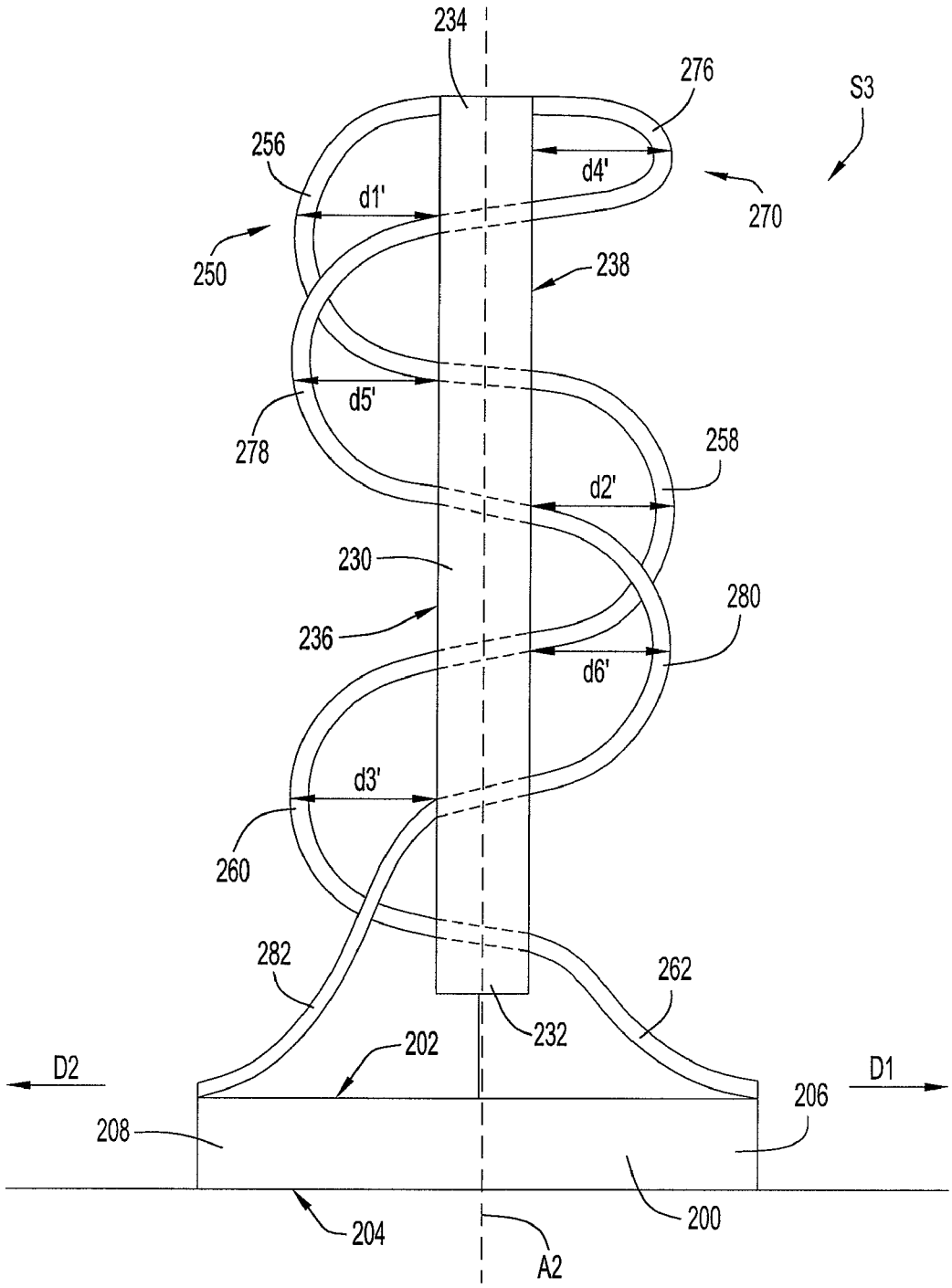
FIG. 6 illustrates another side view schematic diagram of the play set of FIG. 4.

FIGS. 4, 5 and 6 illustrate schematic diagrams of a vehicle track play set S3 according to another embodiment. Referring first to FIG. 4, play set S3 includes a base 200 and a support 230 extending upwardly from the base 200. The base 200 includes an upper side 202 and an underside 204 configured for resting on a support surface S, and opposing end portions 206, 208. The support 230 has a lower end 232 coupled to the upper side 202 of the base 200, an opposite distal upper end 234, and opposing sides 236, 238 extending between the lower and upper ends 232, 234 of the support 230. The support 230 defines several openings 240*a*, 240*b*, 240*c*, 242*a*, 242*b*, and 242.

The support 230 is illustrated as defining openings 240*a-c*, which include three openings associated with a track 250, and openings 242*a-c* including three openings associated with a track 270. However, the support 230 may be configured to define a different quantity of three openings for track 250, and a different quantity of openings for track 270. In some embodiments, the quantity of openings for track 250 is equal to the quantity of openings for track 270. In other embodiments, the quantity of openings for track 250 is different than the quantity of openings for track 270.

A first track 250 has an end portion 252 connected to the support 230, and another opposite end portion 254. In one embodiment, the first track 250 has a generally spiral configuration and extends through openings 240*a*, 240*b*, 240*c* in the support 230 between the end portions 252, 254 of the first track 250. A second track 270 has an end portion 272 connected to the support 230, and another opposite end portion 274. In one embodiment, the second track 270 has a generally spiral configuration and extends through openings 242*a*, 242*b*, 242*c* of the support 230 between the end portions 272, 274 of the second track 270.

In one embodiment, the end portion 252 of the first track 250 is connected to the support 230 proximate to the upper end 234 of the support 230, and extends outwardly from one side 236 of the support 230. The opposite end portion 254 of the first track 250 is located proximate to end portion 206 of the base 200. In different implementations, end portion 254 may extend beyond the base 200.

Similarly, the end portion 272 of the second track 270 is connected to the support 230 proximate the upper end 234 thereof, and extends outwardly from the opposing side 238 of the support 230. The opposite end portion 274 of the second track 270 is located proximate to the opposing end portion 208 of the base 200. In different implementations, end portion 274 may extend beyond the base 200.

Referring to FIG. 5, the first track 250 is defined by several track segments or curved portions that are coupled to the support 230. The first track 250 includes an upper curved portion 256, an intermediate curved portion 258, and a lower curved portion 260. The upper curved portion 256 includes an end 256*a* connected to the support 230, and an opposite end 256*b* connected to the support 230 and aligned with opening 240*a*. The upper curved portion 256 extends outwardly from side 236 of the support 230. The intermediate curved portion 258 includes an end 258*a* connected to the support 230 and aligned with opening 240*a*, and an opposite end 258*b* connected to the support 230 and aligned with opening 240*b*. The intermediate curved portion 258 extends outwardly from the opposing side 238 of the support 230. The lower curved portion 260 includes an end 260*a* connected to the support 230 and aligned with opening 240*b*, and an opposite end 260*b* connected to the support 230 and aligned with opening 240*c*. The lower curved portion 260 extends outwardly from side 236 of the support 230.

Similarly, the second track 270 includes an upper curved portion 276, an intermediate curved portion 278, and a lower curved portion 280. The upper curved portion 276 includes an end 276*a* connected to the support 230, and an opposite end 276*b* connected to the support 230 and aligned with opening 242*a*. The upper curved portion 276 extends outwardly from side 238 of the support 230. The intermediate curved portion 278 includes an end 278*a* connected to the support 230 and aligned with opening 242*a*, and an opposite end 278*b* connected to the support 230 and aligned with opening 242*b*. The intermediate curved portion 278 extends outwardly from side 236 of the support 230. The lower curved portion 280 includes an end 280*a* connected to the support 230 and aligned with opening 242*b*, and an opposite end 280*b* connected to the support 230 and aligned with opening 242*c*. The lower curved portion 280 extends outwardly from side 238 of the support 230.

In one embodiment, the first track 250 is coupled to an exit ramp 262. The exit ramp 262 includes an end 262*a* connected to the support 230 and aligned with opening 240*c*, and an opposite end 262*b* extending outwardly from side 238 of the support 230. The end 260*b* of the lower curved portion 260 of the first track 250, which is aligned with opening 240*c*, is thereby coupled to the exit ramp 262. The end 262*b* of the exit ramp 262 is coupled to end portion 206 of the base 200.

Similarly, the second track 270 may be coupled to another exit ramp 282. The exit ramp 282 includes an end 282*a* connected to the support 230 and aligned with opening 242*c*, and an opposite end 282*b* extending outwardly from side 236 of the support 230. The end 280*b* of the lower curved portion 280 of the second track 270, which is aligned with opening 242*c*, is thereby coupled to the exit ramp 282. The end 282*b* of the exit ramp 282 is coupled to the opposing end portion 208 of the base 200.

Thus, with respect to the first track 250, opening 240*a* is between and interconnecting end 256*b* of the upper curved portion 256 and end 258*a* of the intermediate curved portion 258. Opening 240*b* is between and interconnecting end 258*b* of the intermediate curved portion 258 and end 260*a* of the lower curved portion 260. Opening 240*c* is between and interconnecting end 260*b* of the lower curved portion 260 and end 262*a* of the exit ramp 262.

With respect to the second track 270, opening 242*a* is between and interconnecting end 276*b* of the upper curved portion 276 and end 278*a* of the intermediate curved portion 278. Opening 242*b* is between and interconnecting end 278*b* of the intermediate curved portion 278 and end 280*a* of the lower curved portion 280. Opening 242*c* is between and interconnecting end 280*b* of the lower curved portion 280 and end 282*a* of the exit ramp 282.

In one embodiment, each of the first and second tracks 250, 270 has a generally helical configuration, spiraling from the upper end 234 of the support 230 toward the lower end 232 of the support 230. Referring to FIG. 6, the upper curved portion 256 of the first track 250 extends outwardly from side 236 of the support 230 by a first distance d1', the intermediate curved portion 258 extends outwardly from the opposing side 238 by a second distance d2', and the lower curved portion 260 extends outwardly from side 236 by a third distance d3'. In one embodiment, the first, second and third distances d1', d2', d3' are substantially equal. In other embodiments, the first, second and/or third distances d1', d2', d3' differ.

Similarly, the upper curved portion 276 of the second track 270 extends outwardly from side 238 of the support 230 by a fourth distance d4', the intermediate curved portion 278 extends outwardly from the opposing side 236 by a fifth distance d5', and the lower curved portion 280 extends outwardly from side 238 by a sixth distance d6'. In one embodiment, the fourth, fifth and sixth distances d4', d5', d6' are substantially equal. In other embodiments, the fourth, fifth and/or sixth distances d4', d5', d6' differ.

In one embodiment, the first and fourth distances d1', d4' are substantially equal, the second and fifth distances d2', d5' are substantially equal, and the third and sixth distances d3', d6' are substantially equal. Thus, in one embodiment, the first and second tracks 250, 270 have a relatively symmetrical configuration relative to a longitudinal axis A2 of the support 230. The resulting configuration of the play set S3 is stable and not easily tipped from its upright position when the underside 204 of the base 200 is resting on the support surface S.

In one embodiment, the first track 250 remains within a footprint defined by the base 200 as the first track 250 extends from its upper curved portion 256 to its lower curved portion 260. Similarly, the second track 270 remains within the footprint of the base 200 as the second track 270 extends from its upper curved portion 276 to its lower curved portion 280. Exit ramps 262, 282 likewise may remain within the footprint defined by the base 200. In other embodiments, the first track 250, the second track 270 and/or one or both of the exit ramps 262, 282 may extend outwardly from side 236 and/or side 238 of the support 230 and beyond the footprint of the base 200. The base 200 and/or the support 230 should be sufficiently configured and weighted to ensure that the play set S3 is relatively stable and easily maintained in its upright position on the support surface S, such as during play.

The first and second tracks 250, 270 are configured for receiving toy vehicles (such as toy vehicles 700 described below). In one embodiment, the downward slopes of the first and second tracks 250, 270 are sufficient to allow non-powered wheeled vehicles to proceed down the tracks 250, 270 via gravity. Toy vehicles proceed down the first ramp 250 and are discharged from exit ramp 262 in a first direction D1. Toy vehicles proceed down the second ramp 270 and are discharged from exit ramp 282 in a second direction D2 different from the first direction D1. In one embodiment, the first direction D1 is opposite to the second direction D2. In other embodiments, the first direction D1 is perpendicular to, or angular to, the second direction D2.

Play set S3 may include sensory output, such as lights, sound effects and/or music, as described above. Accordingly, play set S3 may include switches and/or buttons for activating the sensory output, which may be triggered by the child and/or by vehicles proceeding along the first and/or the second tracks 250, 270.

Figure 7:
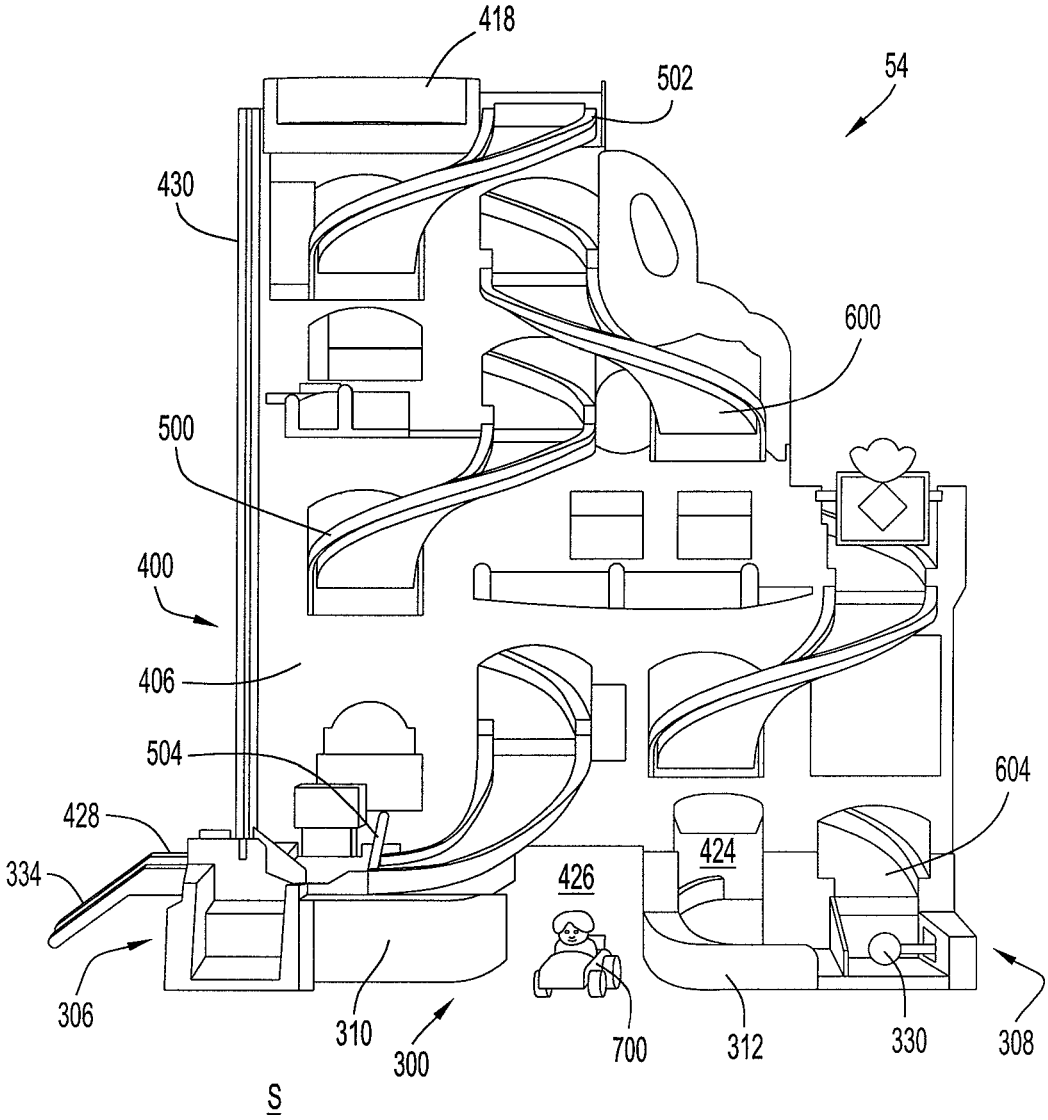
FIG. 7 illustrates a front view of a vehicle track play set according to an alternative embodiment.
Figure 8:
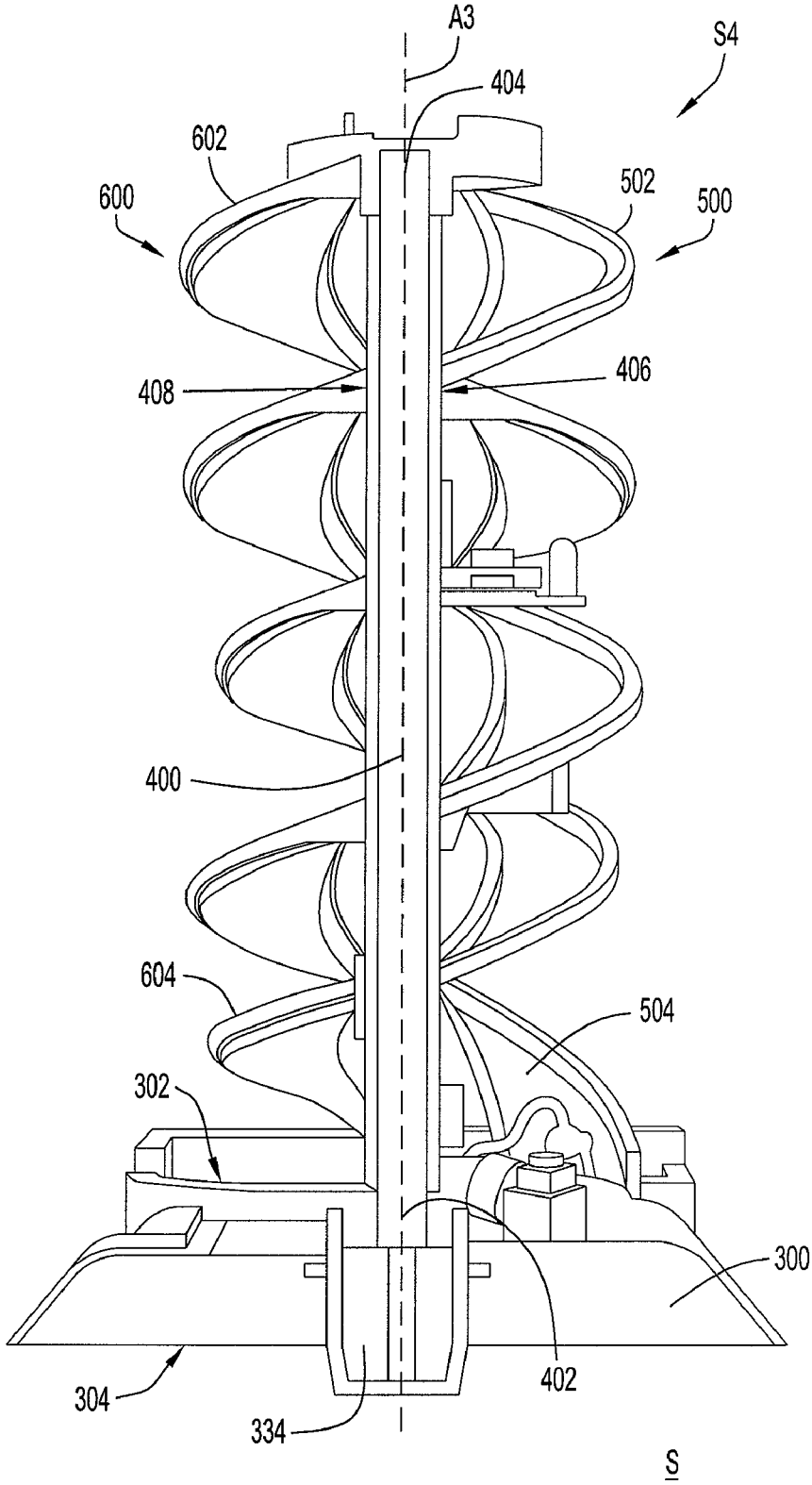
FIG. 8 illustrates a side view of the play set of FIG. 7.

A vehicle track play set S4 according to another embodiment is illustrated in FIGS. 7 and 8. Play set S4 includes a base 300 and a support 400 extending upwardly from the base 300. First and second tracks 500, 600 are coupled to the support 400, and extend along the support 400 toward the base 300. The play set S4 may include one or more toy vehicles configured for engaging and moving along the tracks 500, 600. Accordingly, the first and second tracks 500, 600 are configured to accommodate toy vehicles.

Figure 9:
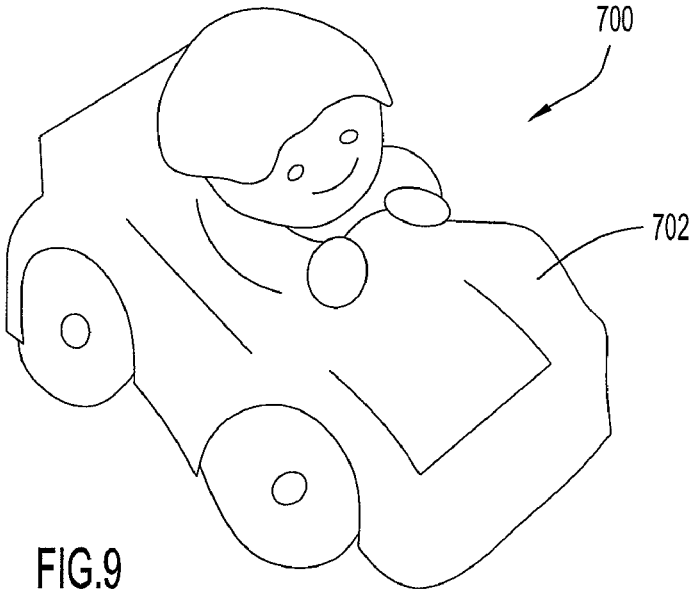
FIG. 9 illustrates a perspective view of an exemplary toy vehicle for use with the play set of FIG. 7.
Figure 10:
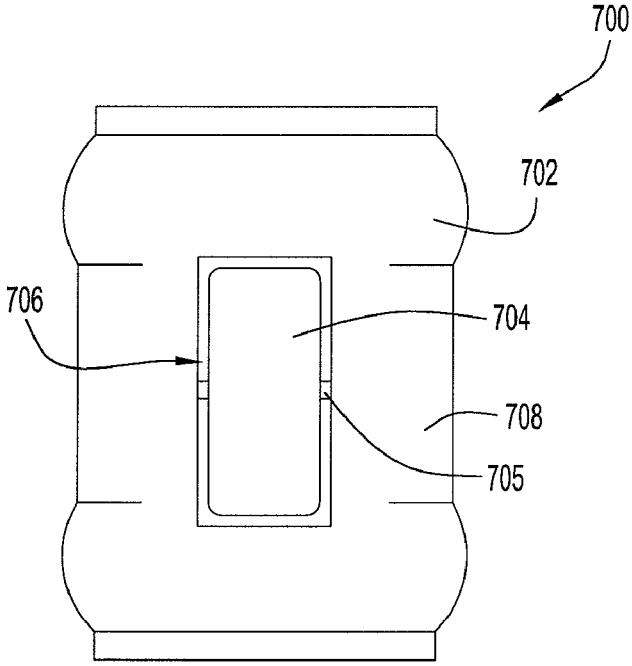
FIG. 10 illustrates a bottom view of the toy vehicle of FIG. 9.

In one embodiment, the play set S4 includes a single-wheeled toy vehicle 700 having a main body 702 that houses a wheel 704, as shown in FIGS. 9 and 10. The wheel 704 mounted on an axle 705 extends outwardly from an opening 706 disposed in an underside 708 of the main body 702. The wheel 704 is engagable with the first track 500 and/or the second track 600, so that the toy vehicle 700 is movable along the first and/or second tracks 500, 600. Thus, the toy vehicle 700 has a relatively limited number of moving components. The size and configuration of the toy vehicle 700 is well suited for use by toddlers and small children.

Referring again to FIGS. 7 and 8, the base 300 has an upper side 302 and an underside 304 configured for resting on a support surface S, and opposing end portions 306, 308. The support 400 has a lower end portion 402 connected to the base 300, an opposite distal upper end portion 404, and opposing sides 406, 408 extending between the lower end portion 402 and the upper end portion 404 thereof.

Figure 11:
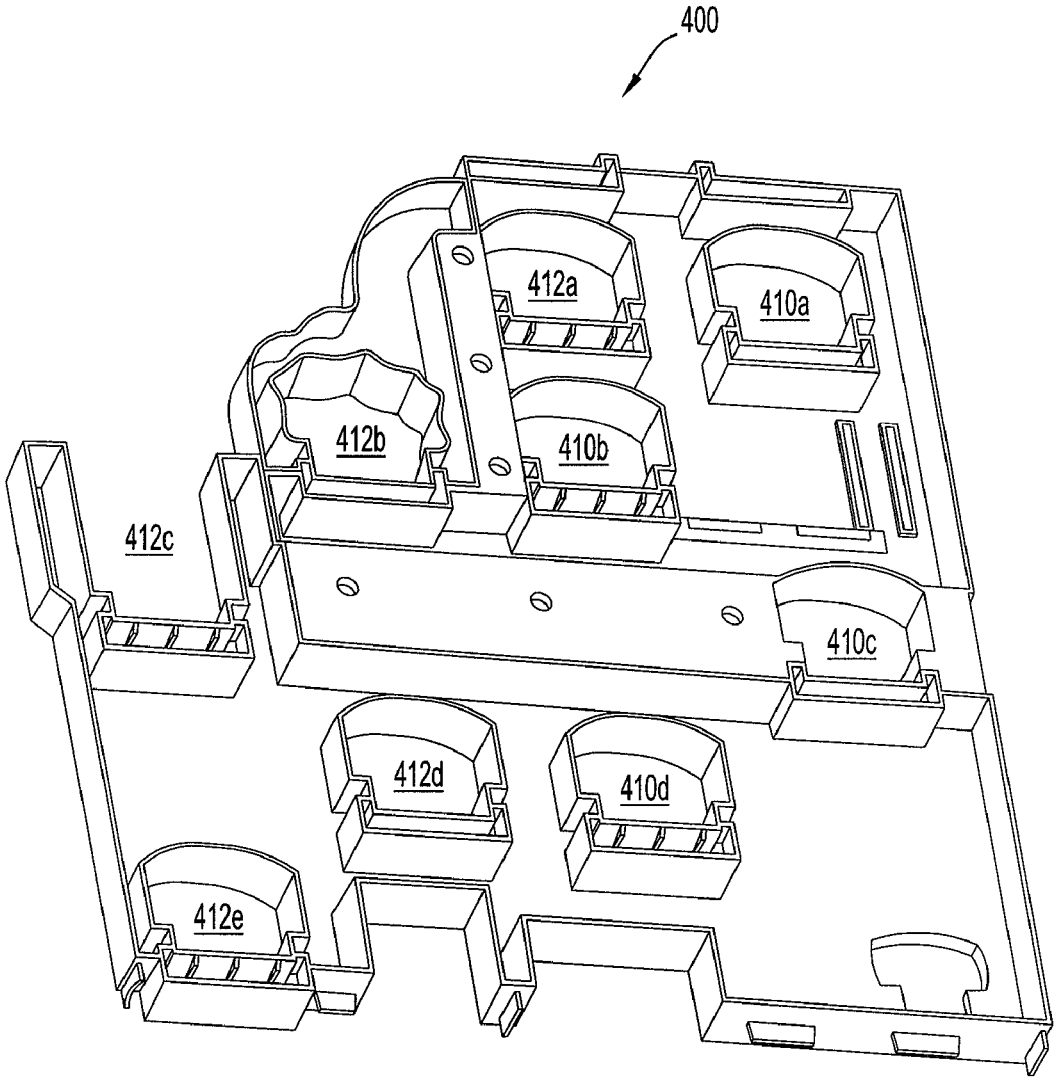
FIG. 11 illustrates a perspective view of a support of the play set of FIG. 7.

Referring to FIG. 11, the support 400 defines a first plurality or group of openings 410*a*, 410*b*, 410*c*, 410*d* and a second plurality or group of openings 412*a*, 412*b*, 412*c*, 412*d*, 412*e*.

Each of the openings 410*a*-410*d* extends through the support 400. The quantity of openings of the groups as illustrated in the figures is exemplary only. Thus, the support 400 may be configured to define a first group of openings including more or less than four openings, and a second group of openings including more or less than five openings. In some embodiments, the support 400 may define a first group of openings including a first quantity of openings, and a second group of openings including a second quantity of openings equal to the first quantity of openings. In other embodiments, the first quantity of openings differs from the second quantity of openings.

Figure 12:
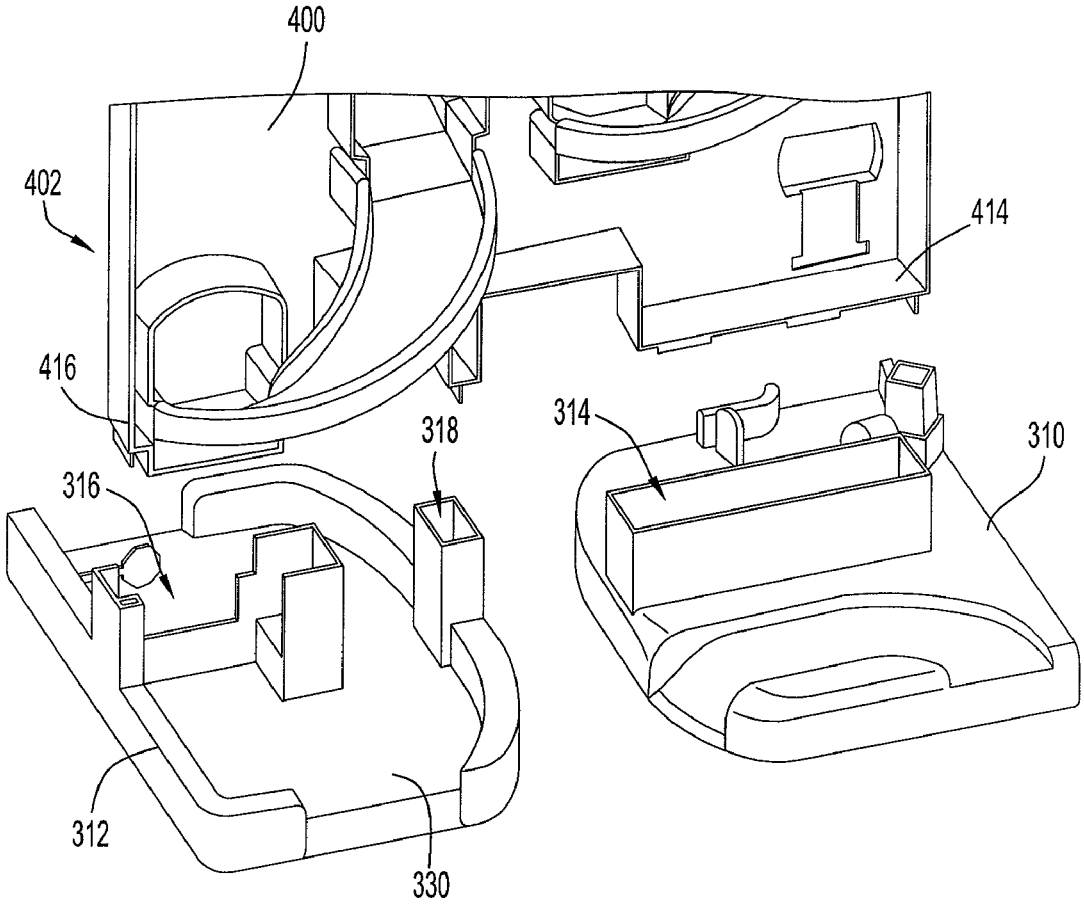
FIG. 12 illustrates a perspective view of a base and a portion of the support and tracks of the play set of FIG. 7.

Referring to FIGS. 7 and 12, in one embodiment, the base 300 includes a first portion 310 and a second portion 312 spaced from the first portion 310. The lower end portion 402 of the support 400 includes a section 414 connected to the first portion 310 of the base 300, and another section 416 connected to the second portion 312 of the base 300. The first portion 310 of the base may include an engagement slot 314 configured for receiving section 414 of the lower end portion 402 of the support 400. The second portion 312 may include engagement slots 316, 318 configured for receiving section 416 of the lower end portion 402 of the support 400. Sections 414, 416 of the lower end portion 402 slide into place within the correspondingly configured engagement slots 314, 316, 318 on the first and second portions 310, 312 of the base 300, respectively, and are retained therein by friction fit, lock tabs, pins, screws, or some other fastening mechanism or means.

In an alternative embodiment, the base 300 includes a single unitary component. In other embodiments, the base 300 may include more than two portions. Therefore, the embodiment including a base 300 having two spaced portions is exemplary only. Further, the base 300 and support 400 may be integrally formed as a single component, or multiple components wherein at least one of the components includes a portion of the base and a portion of the support. Thus, various alternative configurations of the components may be made without departing from the spirit of the invention.

Referring again to FIGS. 7 and 8, the first track 500 has an end portion 502 connected to the support 400, and another opposite end portion 504 located near the base 300. In one embodiment, the end portion 502 is connected to an upper platform 418 defined by or connected to the upper end portion 404 of the support 400 (see also FIG. 13). The upper platform 418 includes opposing sides 420, 422. The end portion 502 of the first track 500 is connected to and extends outwardly from side 420 of the upper platform 418. As shown in FIG. 7, the opposite end portion 504 of the first track 500 may be connected to the first portion 310 of the base 300. The first track 500 has a generally spiral configuration and extends through openings 401*a*-*d* of the support 400 between the end portions 502, 504 of the first track 500.

Figure 13:
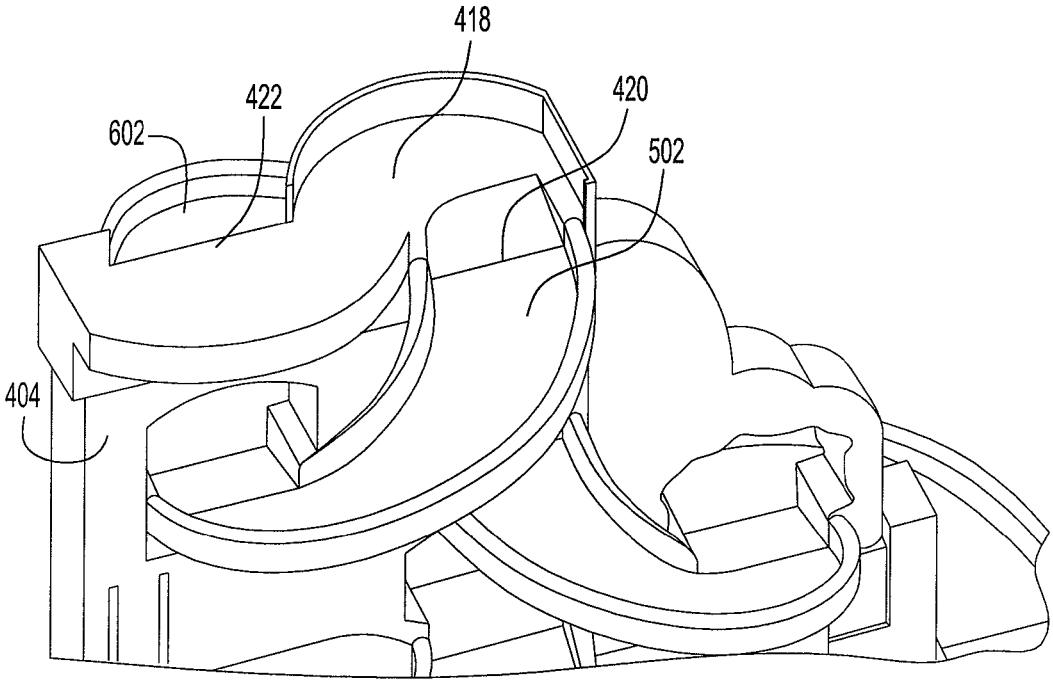
FIG. 13 illustrates a perspective view of an upper portion of the support and tracks of the play set of FIG. 7.

The second track 600 has an end portion 602 connected to the support 400, and another opposite end portion 604 located near the base 300. In one embodiment, the end portion 602 is connected to the upper platform 418, and extends outwardly from the opposing side 422 of the platform 418, as shown in FIG. 13. Thus, the end portion 502 of the first track 500 extends outwardly from one side 406 of the support 400, and the end portion 602 of the second track 600 extends outwardly from the opposing side 408 of the support 400 (as shown in FIG. 8). The opposite end portion 604 of the second track 600 may be connected to the second portion 312 of the base 300, as shown in FIG. 7. The second track 600 has a generally spiral configuration and extends through openings 412*a*-*e* of the support 400 between the end portions 602, 604 of the second track 600.

Figure 14:
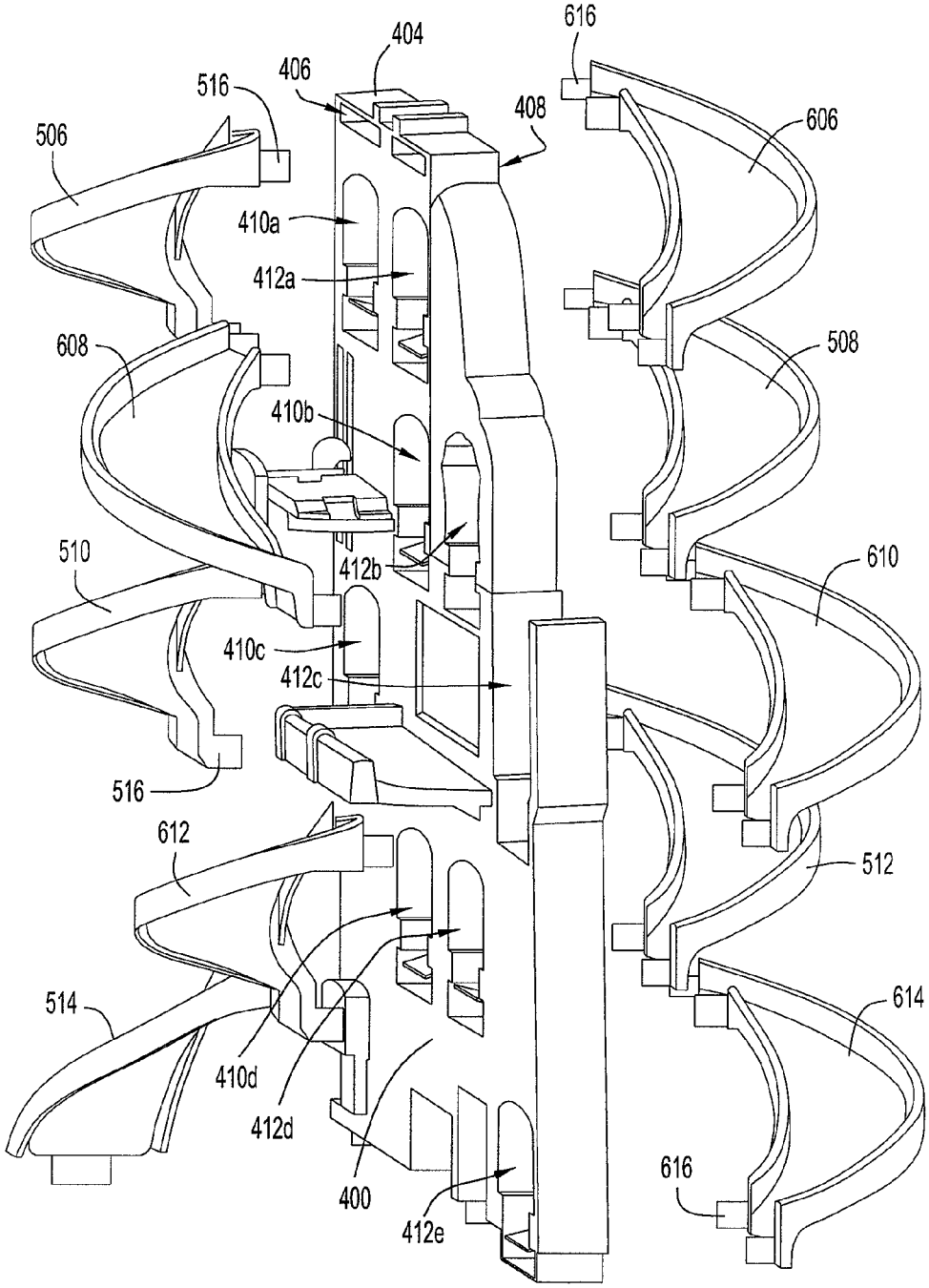
FIG. 14 illustrates a perspective assembly view of the support and portions of the tracks of the play set of FIG. 7.

Referring to FIG. 14, the first and second tracks 500, 600 may be defined by several track segments or curved portions that are coupled to the support 400. In one embodiment, the first track 500 includes an upper curved portion 506, intermediate curved portions 508, 510, 512, and a lower curved portion 514. Similarly, the second track 600 includes an upper curved portion 606, intermediate curved portions 608, 610, 612, and a lower curved portion 614.

In one embodiment, the curved portions 506-514 of the first track 500 include retaining clips 516 extending outwardly from opposing ends of each curved portion 506-514 of the first track 500, and the curved portions 606-614 of the second track 600 include retaining clips 616 extending outwardly from opposing ends of each curved portion 606-614. The retaining clips 516, 616 snap into correspondingly configured and located slots (not shown) provided in the opposing sides 406, 408 of the support 400.

A snap-fit connection of the support 400 to the base 300, and the first and second tracks 500, 600 to the support 400, provide for a relatively quick and easy assembly. The play set S4 is easily assembled by inserting the support 400 into the first and second portions 310, 312 of the base 300, and snapping the curved portions 506-514, 606-614 onto the support 400. However, other mechanisms may be employed for connecting the support 400 to the base 300, and/or for connecting the first and second tracks 500,600 to the support 400, such as screws, pins, adhesive, etc. Further, in other embodiments, the first track 500 and/or the second track 600 may have a unitary construction, and the support 400 may be defined by multiple members that are connected to the first and second tracks 500, 600. Thus, the specific construction and arrangement of components defining the play set S4 as illustrated herein is exemplary only.

With respect to the first track 500, the upper curved portion 506 extends outwardly from side 406, and extends between and interconnects the upper end portion 404 (and/or platform 418 as shown in FIG. 13) of the support 400 and opening 410*a*. Intermediate curved portion 508 extends outwardly from the opposing side 408, and extends between and interconnects opening 410*a* and opening 410*b* of the support 400. Intermediate curved portion 510 extends outwardly from side 406, and extends between and interconnects opening 410*b* and opening 410*c* of the support 400. Intermediate curved portion 512 extends outwardly from the opposing side 408, and extends between and interconnects opening 410*c* and opening 410*d* of the support 400. The lower curved portion 514 extends outwardly from side 406, and extends between and interconnects opening 410*d* and the first portion 310 of the base 300.

Thus, in this embodiment, opening 410*a* is between and interconnecting the curved portion 506 and curved portion 508 of the first track 500. Opening 410*b* is between and interconnecting curved portion 508 and curved portion 510. Opening 410*c* is between and interconnecting curved portion 510 and curved portion 512. Opening 410*d* is between and interconnecting curved portion 512 and curved portion 514.

With respect to the second track 600, the upper curved portion 606 extends outwardly from side 408, and extends between and interconnects the upper end portion 404 (and/or platform 418 as shown in FIG. 13) of the support 400 and opening 412*a*. Intermediate curved portion 608 extends outwardly from the opposing side 406, and extends between and interconnects opening 412*a* and opening 412*b* of the support 400. Intermediate curved portion 610 extends outwardly from side 408, and extends between and interconnects opening 412*b* and opening 412*c* of the support 400. Intermediate curved portion 612 extends outwardly from the opposing side 406, and extends between and interconnects opening 412*c* and opening 412*d* of the support 400. Lower curved portion 614 extends outwardly from side 408, and extends between and interconnects opening 412*d* and opening 412*e*, which is adjacent the second portion 312 of the base 300.

Thus, opening 412*a* is between and interconnecting the curved portion 606 and curved portion 608 of the second track 600. Opening 412*b* is between and interconnecting curved portion 608 and curved portion 610. Opening 412*c* is between and interconnecting curved portion 610 and curved portion 612. Opening 412*d* is between and interconnecting curved portion 612 and curved portion 614. Opening 412*e* is between and interconnecting curved portion 614 and the second portion 312 of the base 300.

Each of the first and second tracks 500, 600 has a generally helical configuration, spiraling from the upper end portion 404 of the support 400 toward the lower end portion 402 of the support 400, as shown in FIG. 8. Thus, the first and second tracks 500, 600 have a relatively symmetrical configuration relative to a longitudinal axis A3 of the support 400. The curved portions 506-514 of the first track 500 and the curved portions 606-614 of the second track 600 extend outwardly from the opposing sides 406, 408 of the support 400 by selected distances, such as described above with reference to FIG. 6.

In some embodiments, the first and second tracks 500, 600 remain within a footprint defined by the base 300 as the tracks 500, 600 extend from their upper end portions 502, 602 to their lower end portions 504, 604. In other embodiments, the first track 500 and/or the second track 600 extend outwardly from and beyond the footprint defined by the base 300. However, the resulting configuration of the play set S4 should be relatively stable and not easily tipped from an upright position when the underside 304 of the base 300 is resting on the support surface S, such as during play.

The first track 500 is coupled to the first portion 310 of the base 300, and the second track 600 is coupled to the second portion 312 of the base 300. The first and/or second portions 310, 312 of the base 300 may include auxiliary track sections integrally formed on or connected to an upper side thereof.

Figure 15:
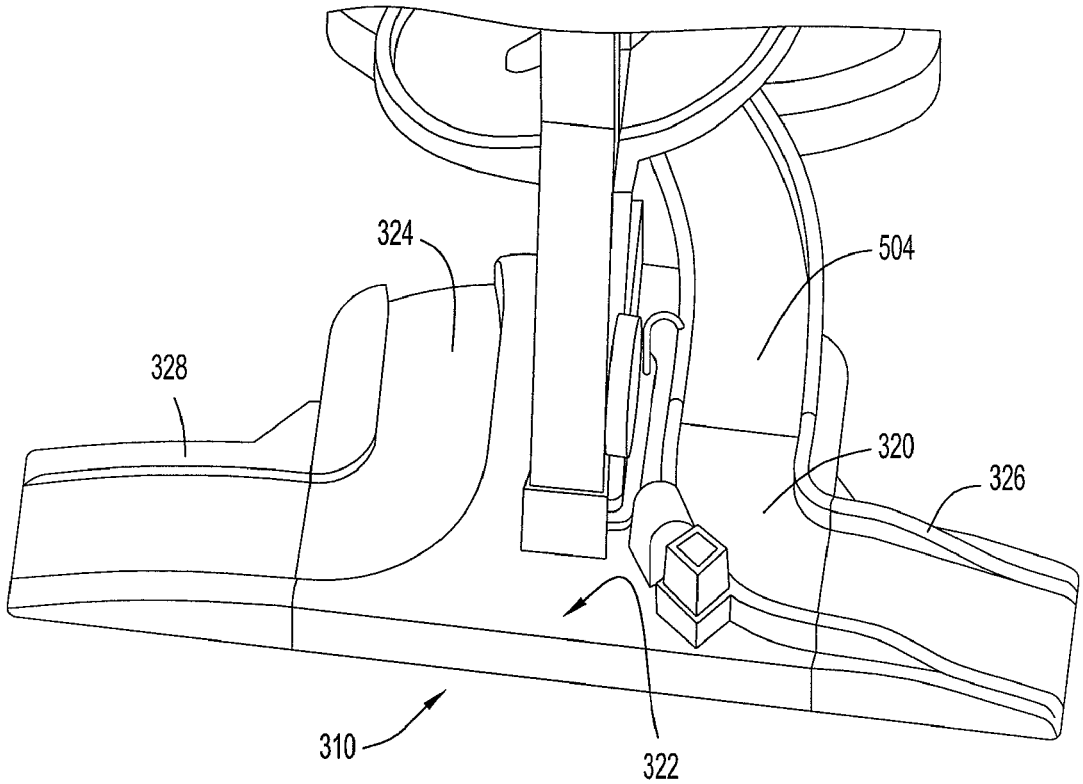
FIG. 15 illustrates a perspective view of a portion of the base of the play set of FIG. 7.

In one embodiment, the first portion 310 of the base 300 includes an auxiliary track section 320 integrally formed in (or coupled to) an upper side 322 thereof, as illustrated in FIG. 15. Auxiliary track section 320 is connected to end portion 504 of the first track 500, thereby coupling the first track 500 to the first portion 310 of the base 300. The first portion 310 may include another auxiliary track section 324 integrally formed in (or coupled to) the upper side 322. The first portion 310 may additionally include one or more extension or exit ramps 326, 328 aligned with and extending outwardly from the auxiliary track sections 320 and/or 324, respectively. Exit ramps 326, 328 may be connected to the first portion 310 of the base 300 via retaining clips, screws, pins, adhesive, etc. Alternatively, the first portion 310 and exit ramps 326, 328 may be integrally formed as a unitary component.

Similarly, the second portion 312 of the base 300 may include one or more auxiliary track sections. In one embodiment, the second portion 312 includes an auxiliary track section 330 formed in (or coupled to) an upper side 332 thereof, as illustrated in FIGS. 7 and 12. The auxiliary track section 330 extends around section 416 of the support 400, and through an auxiliary opening 424 defined by the support 400 and adjacent to opening 412*e* (shown in FIG. 11). In one embodiment, auxiliary track section 330 is connected to end portion 604 of the second track 600, thereby coupling the second track 600 to the second portion 312 of the base 300. The second portion 312 may additionally include one or more exit ramps, as described above with respect to the first portion 310 of the base.

The first and second portions 310, 312 of the base 300 and the support 400 attached thereto define another auxiliary opening 426 through which toy vehicles 700 (or other toys) may pass. Play set S4 may include additional openings, exit ramps, and auxiliary track sections. Thus, the specific configuration and arrangement of the described features as illustrated is exemplary only.

Referring again to FIG. 7, play set S4 may include a lift 428 slidably coupled to a track 430 disposed along and connected to (or defined by) an edge of the support 430. The lift 428 is movable between the first portion 310 of the base 300 and the platform 418 at the upper end portion 404 of the support 400. In one embodiment, an entry ramp 334 extends outwardly from the first portion 310 of the base 300, and leads to the lift 428. A toy vehicle, e.g. toy vehicle 700, may be pushed up the entry ramp 334 and onto the lift 428. The lift 428 may then be raised to a position adjacent the platform 418, and the vehicle rolled off the lift 428 and onto the platform 418. The lift 428 and/or track 430 may include a lock mechanism to releasably retain the lift 428 in the raised position adjacent the platform 418, such as a cooperating detent and groove configuration, a sliding pin, a latch, etc. The play set S4 may also include one or more pivoting gates which may be selectively pivoted across or away from the path of the first track 500 and/or the second track 600.

Figure 16:
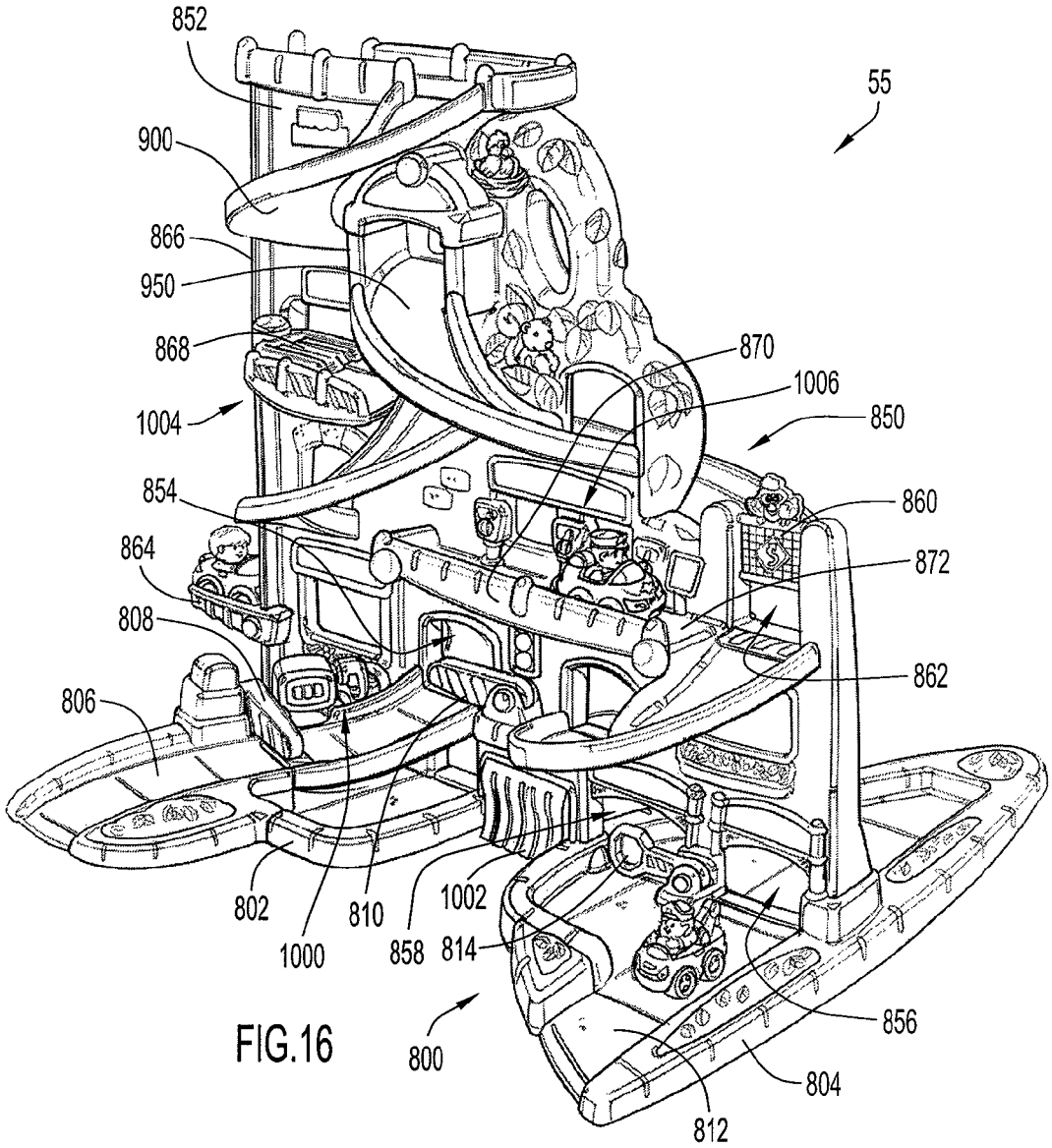
FIG. 16 illustrates a perspective view of a vehicle track play set according to an alternative embodiment.

Thus, play set S4 (or play sets S1, S2 or S3) may include various additional features that enhance the play experience. A vehicle track play set S5 according to another embodiment and exemplifying such additional features is illustrated in FIG. 16. Similarly to play set S4, play set S5 includes a base 800, a support 850 connected to and extending upwardly from the base 800, and first and second tracks 900, 950 coupled to the support 850 and extending from an upper end portion 852 of the support 850 toward the base 800. The first track 900 has a spiraling configuration and extends through a first group of openings defined by the support 850, and the second track 950 has a spiraling configuration and extends through a second group of openings defined by the support 850, as described above.

The base 800 is similar to the base 300 of play set S4, and includes a first portion 802 and a second portion 804 spaced from the first portion 802. The first portion 802 includes an exit ramp 806. A lower end of the first track 900 is coupled to the exit ramp 806. A gate 808 is pivotally mounted between the first track 900 and the exit ramp 806, which may be pivoted across or away from the travel path of the first track 900. Another gate 810 is pivotally mounted adjacent an opening 854 in the support 850 adjacent the lower end of the first track 900, which may likewise be pivoted across or away from the travel path of the first track 900. The gates can be placed proximate to one or more of the openings in the support 850 to stop a toy vehicle at a desired location relative to the support 850.

The second portion 804 of the base 800 also includes an exit ramp 812. A lower end of the second track 950 is coupled to the exit ramp 812. Another gate 814 is pivotally mounted adjacent the support 850 and between openings 856, 858 in the support 850. The gate 814 may be pivoted between a first position blocking one opening 856 and another position blocking the other opening 858 (as shown in FIG. 16) and thus the travel path of the second track 950.

One or more spinning elements may be coupled to the support 850 and extend across or adjacent the first track 900 and/or the second track 950. For example, a spinning element 860 is rotatably coupled to the support 850 and extends across and partially defines an opening 862 through which the second track 950 passes. As a vehicle proceeds along the second track 950 and through opening 862, the spinning element 858 is engaged and rotated.

A lift 864 is slidably coupled to a track 866 disposed along and connected to (or defined by) an edge of the support 850, as described above. Accordingly, the lift 864 is movable between the base 800 and the upper end portion 852 of the support 850. Another auxiliary lift 868 may be coupled to the support 850 and movable toward and away from the base 800.

A central platform 870 is connected to the support 850 and has an end 872 connected to the second track 950. The platform 870 is configured for receiving one or more toy vehicles 700 (or other toys), which may rest thereon and/or be pushed from the end 872 of the platform 870 onto the second track 950.

Play set S5 may include indicia and other elements directed to a particular theme. For example, play set S5 includes a gas pump fill-up area 1000, a car wash area 1002, a repair shop area 1004, and a store front area 1006. However, indicia and components may be directed to other themes, such as an underwater theme, a space theme, a dinosaur theme, etc. These elements can be placed proximate to one or more of the openings in the support 850.

Play set S5 may include electronics and associated mechanisms for providing sensory output, such as flashing lights, sound effects and/or music. Such sensory output may be triggered via actuation of one or more switches or push buttons on the base 800, on the support 850 and/or on the first and/or second tracks 900, 950. In one embodiment, sensory output is triggered upon pivotal movement of gates and/or spinners, such as gates 808, 810, 814 and spinning element 860. Alternatively or in addition, one or more switches may be provided on or adjacent the first track 900 and/or the second track 950, which are triggered as a toy vehicle passes and cause activation of lights, sound effects, or other sensory output. Alternatively or in addition, sensory output may be triggered upon movement of lift 864 and/or lift 868.

In one embodiment, play set S5 includes a mode switch for controlling sensory output. For example, in a first mode all sensory output may be turned off. In a second mode, lights and/or audio output, such as sound effects and music, may be triggered by actuation of one or more switches as described above. In a third mode, primary sensory output such as music may play continuously or for a predetermined period of time, while secondary sensory output such as sound effects may be triggered by actuation of one or more switches. Thus, various combinations and arrangements for providing and actuating sensory output via an electronics package within the play set S5 are possible.

The various components of the play sets can be made of plastic. As mentioned above, one or more of the different openings in the support may have a manipulatable structure proximate thereto that stops toy vehicles at that opening. By stopping a toy vehicle at a particular location, a child can play with the toy vehicle where it is stopped. In one embodiment, the support includes little toy shops or play areas where the tracks intersect the support. The shops or areas create the appearance of the toy vehicle traveling through different towns along a trip. A gate or similar structure can be used to stop the toy vehicle at a particular location, as described above.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A vehicle track play set, comprising:

a base;

a plate having a first end, an opposite second end, and opposing first and second surfaces, the first end of the plate being coupled to the base and the plate extending upwardly from the base;

a first track extending along the plate toward the base, the first track including a first curved portion extending outwardly from the first surface and a second curved portion extending outwardly from the second surface, the first track extending through at least a first opening in the plate between the first curved portion and the second curved portion; and a second track extending along the plate toward the base, the second track including a third curved portion extending outwardly from the second surface and a fourth curved portion extending outwardly from the first surface, the second track extending through at least a second opening in the plate between the third curved portion and the fourth curved portion.

2. The vehicle track play set of claim 1, wherein the at least a first opening in the plate includes a first plurality of openings, the first track having a spiral configuration and extending through the first plurality of openings.

3. The vehicle track play set of claim 2, wherein the at least a second opening in the plate includes a second plurality of openings, the second track having a spiral configuration and extending through the second plurality of openings.

4. The vehicle track play set of claim 1, wherein the first track extends through a third opening in the plate after the second curved portion, and the first track includes a fifth curved portion and a sixth curved portion, the first track extending through a fourth opening in the plate between the fifth curved portion and the sixth curved portion.

5. The vehicle track play set of claim 1, wherein the first track is coupled to a first exit ramp extending from a first side of the base, and the second track is coupled to a second exit ramp extending from a second side of the base opposite the first side.

6. The vehicle track play set of claim 1, further comprising a single-wheeled toy vehicle configured for engaging and moving along the first and second tracks.

7. The vehicle track play set of claim 1, wherein the first curved portion extends outwardly from the first surface by a first distance, and the second curved portion extends outwardly from the second surface by a second distance, the second distance substantially equal to the first distance.

8. The vehicle track play set of claim 1, wherein the base includes a first portion and a second portion spaced from the first portion, the first track coupled to the first portion of the base, and the second track coupled to the second portion of the base.

9. The vehicle track play set of claim 1, wherein the at least a first opening in the plate includes a first quantity of openings, and the at least a second opening in the plate includes a second quantity of openings, the first quantity differing from the second quantity.

10. A vehicle track play set comprising:

a base;

a support extending upwardly from the base, the support having a first end connected to the base and an opposite distal second end, the support defining a first plurality of openings and a second plurality of openings;

a first track having a first end portion connected to the support and a second opposite end portion, the first track having a spiral configuration and extending through the first plurality of openings of the support between the end portions of the first track; and a second track having a first end portion connected to the support and a second opposite end portion, the second track having a spiral configuration and extending through the second plurality of openings of the support between the end portions of the second track.

11. The vehicle track play set of claim 10, wherein the support includes a first side and a second side extending between the ends of the support, the first end portion of the first track extending outwardly from the first side of the support, and the first end portion of the second track extending outwardly from the second side of the support.

12. The vehicle track play set of claim 10, wherein the second end portion of the first track is located proximate to a first side of the base, and the second end portion of the second track is located proximate to a second side of the base opposite to the first side.

13. The vehicle track play set of claim 10, wherein the first plurality of openings includes a first quantity of openings, and the second plurality of openings includes a second quantity of openings, the first quantity differing from the second quantity.

14. The vehicle track play set of claim 10, wherein the base includes a first portion and a second portion spaced from the first portion, the second end portion of the first track coupled to the first portion of the base, and the second end portion of the second track coupled to the second portion of the base.

15. A vehicle track play set comprising:

a base;

a substantially planar support member extending upwardly from the base, the support member having a first end connected to the base and an opposite distal second end, the support member defining a first plurality of openings extending therethrough;

a first track having a first end portion coupled to the support member and an opposite second end portion, the first track having a spiral configuration and extending through the plurality of openings from the first end portion of the first track to the second end portion of the first track; and a second track having a first end portion coupled to the support member and an opposite second end portion, the second track having a spiral configuration and extending through a second plurality of openings defined by the support member.

16. The vehicle track play set of claim 15, wherein the first track extends outwardly from opposing sides of the support member.

17. The vehicle track play set of claim 15, wherein the first track remains within a footprint defined by the base as the track extends from its first end portion to its second end portion.

18. The vehicle track play set of claim 15, wherein the base includes a first portion and a second portion spaced from the first portion, the first track coupled to the first portion of the base, and the second track coupled to the second portion of the base.

19. The vehicle track play set of claim 15, wherein the support member includes a first side and an opposite second side extending between the first and second ends of the support member, the first end portion of the first track extending outwardly from the first side of the support member, and the first end portion of the second track extending outwardly from the second side of the support member.

* * * * *

UNITED STATES PATENT AND TRADEMARK OFFICE

CERTIFICATE OF CORRECTION

PATENT NO. : 8,066,545 B2
APPLICATION NO. : 12/575089
DATED : November 29, 2011
INVENTOR(S) : Jourdian et al.

It is certified that error appears in the above-identified patent and that said Letters Patent is hereby corrected as shown below:

Column 3, line 46 change "Si" to --S1--.

Signed and Sealed this
Twenty-eighth Day of February, 2012

David J. Kappos

David J. Kappos
*Director of the United States Patent and Trademark Office*